US010533380B2

(12) United States Patent
Fripp et al.

(10) Patent No.: US 10,533,380 B2
(45) Date of Patent: Jan. 14, 2020

(54) DOWNHOLE CAPACITIVE COUPLING SYSTEMS

(71) Applicant: Halliburton Energy Services, Inc., Houston, TX (US)

(72) Inventors: Michael Linley Fripp, Carrollton, TX (US); Stephen Michael Greci, Little Elm, TX (US); Thomas Jules Frosell, Irving, TX (US); Richard Decena Ornelaz, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 258 days.

(21) Appl. No.: 15/532,401

(22) PCT Filed: Jul. 20, 2016

(86) PCT No.: PCT/US2016/043185
§ 371 (c)(1),
(2) Date: Jun. 1, 2017

(87) PCT Pub. No.: WO2018/017081
PCT Pub. Date: Jan. 25, 2018

(65) Prior Publication Data
US 2018/0347288 A1 Dec. 6, 2018

(51) Int. Cl.
*E21B 17/02* (2006.01)
*E21B 47/00* (2012.01)
(Continued)

(52) U.S. Cl.
CPC ..... *E21B 17/028* (2013.01); *E21B 43/108* (2013.01); *E21B 47/00* (2013.01); *E21B 49/08* (2013.01); *H01R 13/52* (2013.01)

(58) Field of Classification Search
CPC ..... E21B 17/028; E21B 47/122
See application file for complete search history.

(56) References Cited

U.S. PATENT DOCUMENTS 4,866,607 A 9/1989 Anderson et al.
5,455,573 A * 10/1995 Delatorre ..... E21B 17/028 166/250.11
(Continued)

FOREIGN PATENT DOCUMENTS

WO 9623368 A1 8/1996
WO 2015069214 A1 5/2015
(Continued)

OTHER PUBLICATIONS

Van den Steen, L. "New Developments in Inductive and Capacitive Underwater Electrical Connectors." Offshore Technology Conference. Offshore Technology Conference, 1988.
(Continued)

*Primary Examiner* — Jennifer H Gay
(74) *Attorney, Agent, or Firm* — McGuireWoods LLP

(57) ABSTRACT

The disclosed embodiments include downhole capacitive coupling systems, and methods and apparatuses to provide an electrical connection between two downhole strings. In one embodiment, the system includes a first electrode deployed along an internal surface of a first string deployed in a wellbore, the internal surface being defined by an annulus. The system also includes a second electrode deployed along an external surface of a second string, the second string being deployed within the annulus, and the external surface of the second string and the internal surface of the first string being separated from each other by the annulus. The first electrode and the second electrode are operable to form a first capacitive coupling between said first electrode and said second electrode to transfer electrical current from the second electrode to the first electrode.

19 Claims, 4 Drawing Sheets

(51) Int. Cl.

| | |
|---|---|
| ***H01R 13/52*** | (2006.01) |
| ***E21B 49/08*** | (2006.01) |
| ***E21B 43/08*** | (2006.01) |
| ***E21B 43/10*** | (2006.01) |

(56) References Cited

U.S. PATENT DOCUMENTS

| | | | | |
|---|---|---|---|---|
| 6,727,827 | B1 * | 4/2004 | Edwards | E21B 47/122 324/339 |
| 7,793,718 | B2 * | 9/2010 | Patel | E21B 17/028 166/227 |
| 7,902,955 | B2 * | 3/2011 | Veneruso | E21B 47/122 336/174 |
| 8,082,990 | B2 * | 12/2011 | Lovell | E21B 17/028 166/242.6 |
| 8,102,276 | B2 * | 1/2012 | Sugiura | G01V 11/002 166/380 |
| 8,432,294 | B2 | 4/2013 | Davis | |
| 8,469,084 | B2 * | 6/2013 | Clark | E21B 33/124 166/65.1 |
| 8,567,524 | B2 | 10/2013 | Schimanski | |
| 9,007,233 | B2 * | 4/2015 | Sugiura | G01V 11/002 166/380 |
| 9,175,560 | B2 * | 11/2015 | Algeroy | E21B 47/122 |
| 10,036,234 | B2 * | 7/2018 | Sponchia | E21B 41/0035 |
| 10,047,602 | B2 * | 8/2018 | Turner | E21B 47/122 |
| 10,119,343 | B2 * | 11/2018 | Sugiura | E21B 47/12 |
| 10,145,233 | B2 * | 12/2018 | Bittar | E21B 7/06 |
| 2008/0041576 | A1 * | 2/2008 | Patel | E21B 17/028 166/65.1 |
| 2009/0066535 | A1 * | 3/2009 | Patel | E21B 17/028 340/853.2 |
| 2009/0085701 | A1 * | 4/2009 | Veneruso | E21B 47/122 336/92 |
| 2009/0151935 | A1 * | 6/2009 | Lovell | E21B 17/07 166/250.03 |
| 2010/0101786 | A1 * | 4/2010 | Lovell | E21B 17/028 166/250.01 |
| 2010/0300678 | A1 * | 12/2010 | Patel | E21B 17/028 166/65.1 |
| 2012/0090827 | A1 * | 4/2012 | Sugiura | E21B 17/028 166/65.1 |
| 2013/0075087 | A1 * | 3/2013 | Algeroy | E21B 47/00 166/250.01 |
| 2013/0192851 | A1 * | 8/2013 | Algeroy | E21B 47/122 166/382 |
| 2013/0248169 | A1 | 9/2013 | Swanson et al. | |
| 2013/0285830 | A1 * | 10/2013 | Hallundb k | G01V 11/002 340/854.9 |
| 2013/0319685 | A1 | 12/2013 | Pike | |
| 2016/0145999 | A1 * | 5/2016 | Clarkson | G01V 3/10 340/854.6 |
| 2016/0258274 | A1 * | 9/2016 | Bittar | E21B 47/01 |
| 2016/0258277 | A1 * | 9/2016 | Bittar | E21B 7/06 |
| 2016/0258283 | A1 * | 9/2016 | Bittar | E21B 43/12 |
| 2016/0258284 | A1 * | 9/2016 | Bittar | E21B 41/0035 |
| 2016/0356911 | A1 * | 12/2016 | Wilson | G01N 27/221 |
| 2017/0067336 | A1 * | 3/2017 | Turner | E21B 17/028 |
| 2017/0350197 | A1 * | 12/2017 | Sugiura | E21B 47/12 |
| 2018/0171784 | A1 * | 6/2018 | Roberson | E21B 47/122 |
| 2018/0347288 | A1 * | 12/2018 | Fripp | E21B 47/12 |
| 2019/0024462 | A1 * | 1/2019 | Sugiura | E21B 47/12 |
| 2019/0032423 | A1 * | 1/2019 | Sugiura | E21B 47/12 |
| 2019/0195028 | A1 * | 6/2019 | Fripp | E21B 17/028 |
| 2019/0203584 | A1 * | 7/2019 | Clarkson | E21B 47/0905 |

FOREIGN PATENT DOCUMENTS

| | | | |
|---|---|---|---|
| WO | 2015147800 | A1 | 10/2015 |
| WO | 2016175827 | A1 | 11/2016 |
| WO | 2017003490 | A1 | 1/2017 |

OTHER PUBLICATIONS

Van den Steen, L. "Conductive, Inductive and Capacitive Subsea Connectors Horses for Courses." Subsea Control and Data Acquisition: Technology and Experience 22 (1990): 47.

International Search Report and Written Opinion date dated Apr. 18, 2017; International PCT Application No. PCT/US2016/043185.

* cited by examiner

DOWNHOLE CAPACITIVE COUPLING SYSTEMS

BACKGROUND

The present disclosure relates generally to downhole capacitive coupling systems, and methods and apparatuses to provide an electrical connection between two downhole strings.

A wellbore is may be drilled proximate to a subterranean deposit of hydrocarbon resources to facilitate exploration and production of hydrocarbon resources. Casing sections are often coupled together to extend an overall length of a casing (e.g., a production casing, an intermediate casing, or a surface casing) that is deployed in the wellbore to insulate downhole tools and strings deployed in the casing as well as hydrocarbon resources flowing through the casing from the surrounding formation, to prevent cave-ins, and to prevent contamination of the surrounding formation.

Casing sections typically have a hollow interior or passage through which one or more retrievable strings may be deployed to facilitate production of hydrocarbon resources. These retrievable strings may include one or more electrical conduits operable to provide electrical currents to a downhole location and to power downhole loads, such as sensors and tools that are coupled to the retrievable strings. Sensors and tools may also be coupled to casings to provide measurements of the surrounding formation. However, it may be difficult or infeasible to deploy electrical conduits along the casings to provide power to sensors and tools that are deployed along the casings.

BRIEF DESCRIPTION OF THE DRAWINGS

Illustrative embodiments of the present disclosure are described in detail below with reference to the attached drawing figures, which are incorporated by reference herein, and wherein.

Figure 1:
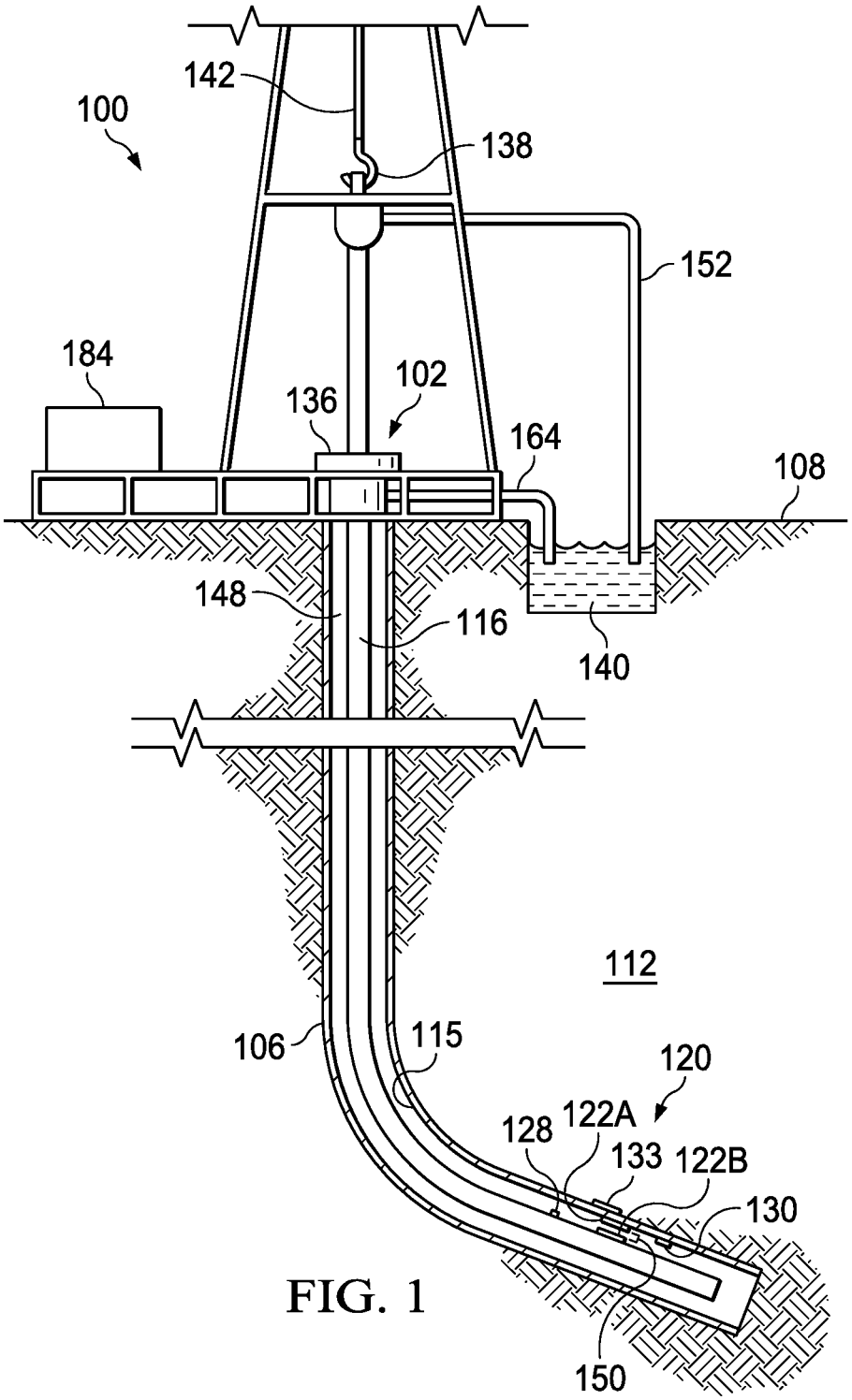
FIG. 1 is a schematic, side view of a hydrocarbon production environment where a first electrode and a second electrode of a downhole capacitive coupling system are deployed along a first string and a second string, respectively, to provide power and telemetry to an electrical load deployed along the first string.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to downhole capacitive coupling systems, and methods and apparatuses to provide an electrical connection between two downhole strings. More particularly, the present disclosure relates to systems, apparatus, and methods to transmit power and data from an inner string to an electrical load deployed along an outer string or to transmit power and data from the outer string to the electrical load deployed on the inner string. The system includes a first electrode that is deployed along a surface of the outer string and a second electrode that is deployed along a surface of the inner string. As defined herein, strings include tubes, wellbore casings, as well as other types of strings that are either permanently deployed along a wellbore or may be retrieved during hydrocarbon production. For example, the outer string (first string) may be one or more sections of a production casing deployed proximate a hydrocarbon formation, and the inner string (second string) may be a production string that is deployed within an annulus of the production casing. In some embodiments, the production casing may be considered as a lower completion. When the first electrode and the second electrode are aligned, the first and second electrodes form a capacitive coupling. An electrical current may be transferred across the capacitive coupling to provide power to an electrical load that is deployed proximate the first string. In some embodiments, the electrical current is transmitted from a surface location, through an electrical conduit, to a controller (formed from one or more drive electronics), and is transferred by the controller across the capacitive coupling to the electrical load. In other embodiments, the electrical current is generated from a downhole location rather than from a surface location.

In some embodiments, the controller also transmits electrical signals indicative of data across the capacitive coupling to the electrical load, thereby forming a telemetry path to the electrical load. In further embodiments, the controller is operable to modulate one or more of the frequency, amplitude, and phase of the electrical current to regulate power transmitted to the electrical load and also to transmit signals indicative of data or commands to the electrical load.

In further embodiments, multiple electrodes are deployed along the first and second strings. In one of such embodiments, an operator may operate a surface based control to position one or more electrodes deployed along the first string to align with one or more electrodes deployed along the second string to form capacitive couplings and to transmit power and data to the electrical load via the capacitive couplings. Additional descriptions of the foregoing system, apparatus, and method to form electrical connections are described in the paragraphs below and are illustrated in FIGS. 1-5.

Turning now to the figures, FIG. 1 is a schematic, side view of a hydrocarbon production environment 100 where a first electrode 122A and a second electrode 122B of a downhole capacitive coupling system 120 are deployed along a first string 115 and a second string 116, respectively, to provide power and telemetry to an electrical load 130 deployed along the first string 115. In the embodiment of FIG. 1, a well 102 having a wellbore 106 extends from a surface 108 of the well 102 to or through a subterranean formation 112. A first string 115 having the first electrode 122A and an internal passage is deployed in the wellbore 105 to insulate downhole tools and strings deployed in the passage of the first string 115 as well as hydrocarbon resources flowing through the first string 115 from the surrounding formation 112, to prevent cave-ins, and/or to prevent contamination of the surrounding formation 112.

A hook 138, cable 142, traveling block (not shown), and hoist (not shown) are provided to lower a second string 116 having the second electrode 122B through the first string 115, down the wellbore 106, or to lift the second string 116 up from the wellbore 106. The second string 116 may be a dip tube, a production tube, or another type of string that is deployable within the passage of the first string 115. In some embodiments, an umbilical (not shown) having an electrical conduit (not shown) is coupled to the second string 116 to provide downhole power and data transmission. When the first and second electrodes 122A and 122B are aligned, a first capacitive coupling 150 is formed between the first and second electrodes 122A and 122B. Electrical currents transmitted downhole through the umbilical may be transferred across the first capacitive coupling 150 to provide power or data transmission to the electrical load 130 as well as other electrical loads that are deployed along the first string 115. A controller 128 formed from one or more drive electronics is operable to (1) receive an indication (a first indication) that the first and second electrodes 122A and 122B are aligned and to (2) drive electrical currents across the first capacitive coupling 150 to provide power or data transmission to the one or more electrical loads upon receiving the first indication.

At wellhead 136, an inlet conduit 152 is coupled to a fluid source (not shown) to provide fluids, such as production fluids, downhole. In some embodiments, the second string 116 has an internal passage that provides a fluid flow path from the surface 108 downhole. In some embodiments, the production fluids travel down the second string 116 and exit the second string 116. The production fluids as well as hydrocarbon resources flow hack toward the surface 108 through a wellbore annulus 148 formed from the passage of the first string 115, and exit the wellbore annulus 148 via an outlet conduit 164 where the production fluids and the hydrocarbon resources are captured in a container 140.

The electrical load 130 is deployed along the first string 115. In some embodiments, the electrical load 130 include sensors, such as but not limited to flow rate sensors, temperature sensors, pressure sensors, flow consumption sensors, magnetometers, accelerometers, pH sensors, vibration sensors, acoustic sensors, as well as other sensors that are operable to determine one or more properties of hydrocarbon resources and/or the surrounding formation 112. The electrical load 130 may also include tools such as, but not limited to valves, sleeves, wireless communication devices, hydraulic pumps, as well as other downhole tools that are operable to monitor and maintain hydrocarbon production and the integrity of the well 102 during the operational life expectancy of the well 102. The tools and sensors may be operable to create, monitor, and maintain zonal isolation to prevent fluid loss, as well as to maintain hydrocarbon production and the integrity of the well 102 in multi-zone wells. In further embodiments, the tools and sensors are deployed proximate A-annulus, B-Annulus, C-Annulus, as well as other annuluses within the wellbore 106 to monitor the pressure, temperature, fluid flow, or other properties proximate the annuluses.

The tools and sensors are deployed proximate one or more types of screens to detect properties of particles flowing through the screens and are operable to form control systems (e.g., control flow devices) to monitor and regulate fluid/particle flow through the screens. In one embodiment, a first screen 133 is disposed on a section of the first string 115. A plurality of sensors disclosed herein and operable to monitor material properties of fluids and particles proximate the screen and flowing through the screen are deployed along the first string 115. Further, a set of tools disclosed herein that are operable to regulate the flow rate of fluids and materials through the first screen are also deployed along the first string 115. Electrical currents may be transferred from the second electrode 122B, across the first capacitive coupling 150 to the first electrode 122A to provide power and data transmission to the sensors and tools that are deployed along the first string 115. Although FIG. 1 illustrates a production well, the technologies described herein may also be implemented in an injection well to provide power and data across different strings deployed in the injection well.

In some embodiments, the foregoing operations are monitored by a surface based control 184, which includes one or more electronic systems. In one of such embodiments, the surface based control 184 is operable to receive one or more indications of whether the first electrode 122A is aligned with the second electrode 122B and to notify an operator whether the first electrode 122A is aligned with the second electrode 122B. The operator may operate the control 184 to re-position the second string 116 until the first electrode 122A and the second electrode 122B are aligned to form the first capacitive coupling 150. In other embodiments, the operator may operate the control 184 to align any one of the electrodes deployed on the first string 115 with another one of the electrodes that are deployed on the second string 116.

Figure 2:
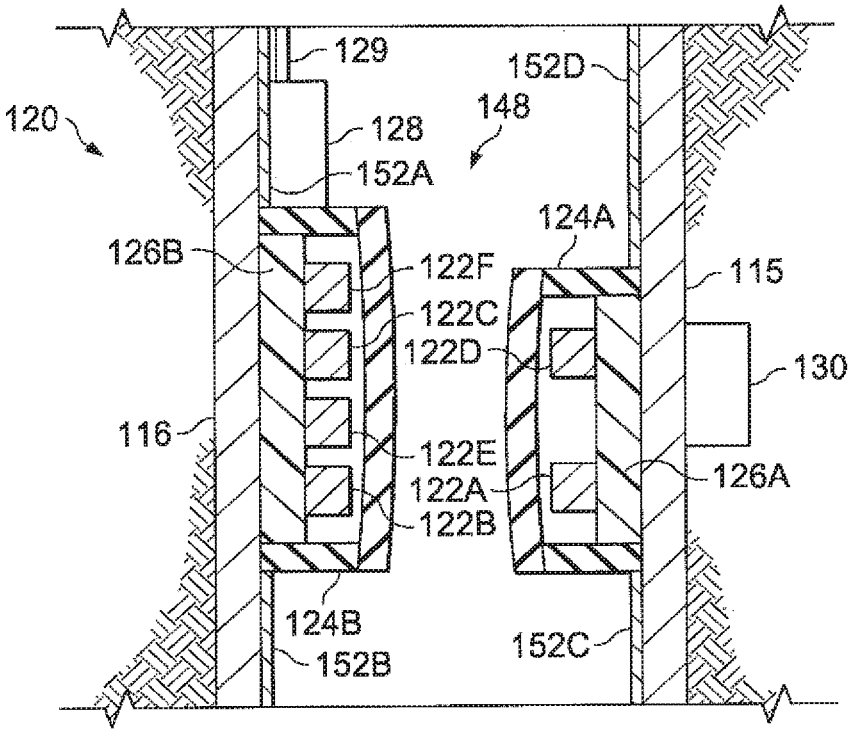
FIG. 2 is an enlarged, side view of the downhole capacitive coupling system of FIG. 1, where two electrodes deployed along the first string are aligned with two electrodes deployed along the second string.

FIG. 2 is an enlarged, side view of the downhole capacitive coupling system 120 of FIG. 1, where two electrodes 122B and 122C deployed along the second string 116 are aligned with two electrodes 122A and 122D deployed along the first string 115. In the embodiment of FIG. 2, a first electrode 122A and a fourth electrode 122D are deployed along the first string 115, and a second electrode 122B, a third electrode 122C, a fifth electrode 122E, and a sixth electrode 122F are deployed along the second string 116. The deployment of additional electrodes provides additional alignment locations along surfaces of the first and second strings 115 and 116. Further, the additional electrodes also facilitate simultaneous power and data transfer at different frequencies, phases, and/or amplitudes.

In some embodiments, such as the embodiment illustrated in FIG. 2, the first and fourth electrodes 122A and 122D are covered by a first covering 124A, and the second, third, fifth, and sixth electrodes 122B, 122C, 122E, and 122F are covered by a second covering 124B. The first and second coverings 124A and 124B protect the electrodes 122A-122F against corrosion. In the preferred embodiment, the first and second coverings 124A and 124B are manufactured from materials that have a high dielectric permittivity and a low electrical resistivity, and are electrically conductive. In the preferred embodiment, the first covering 124A and the second covering 124B contact each other. One or more electrodes 122A-122E may be attached to a flexible mount, such as a spring or a fixture disclosed herein to facilitate contact between the first and second coverings 124A and 124B. In some embodiments, the dielectric permittivity of the first and second coverings 124A and 124B is greater than a first threshold. In some embodiments, the first and second coverings 124A and 124B are manufactured from silicon carbide, silicon nitride, rubber, electrically conductive rubber or another material disclosed herein having a high dielectric permittivity. In one of such embodiments, the first and second coverings 124A and 124B are manufactured from different materials, where each material has a dielectric permittivity that is greater than the first threshold.

As shown in FIG. 2, each of the coverings 124A and 124B spans all of the electrodes covered by the respective covering. In other embodiments, the coverings are segmented such that each electrode is individually covered by one of the coverings. In some embodiments, electrically insulating materials are deployed proximate the electrodes. As shown in FIG. 2, insulators 152A-152D are added at axial locations above and below the electrodes. The insulators 152A-152D reduce electrical shorting between the electrodes 122A-F and the corresponding strings 115 and 116 in cases where wellbore fluid is electrically conductive. The electrical insulating materials may be polymer, ceramic, oxide, or glass such as PTFE plastic, rubber, a swell rubber, paint, enamel, metal oxide, anodized material, carbide coating, etc. In some embodiments, the insulators 152A-152D may approach or touch each other to form a fluid restriction. For example, the second insulator 152B and the third insulator 152C may touch each other to restrict fluid across the second and third insulators 152B and 153C. In another embodiment, one of the insulators 152A-152D may approach or touch the first or the second string 115 or 116 to form a fluid restriction. For example, the second insulator 152B extends across the annulus and touches the first string 115. In some embodiments, one or more of the insulators 152A-152D may extend from 0.25 inches to 10 feet away from the electrodes 122A-122F. Additionally, one or more of the insulators 152A-152D may extend to partially cover a section of one or more of the electrodes 122A-122F or may extend between the one or more electrodes and the corresponding string 115 or 116.

In some embodiments, some of the first-sixth electrodes 122A-122F are manufactured from materials having a high galvanic potential, such as titanium, carbon (graphite), gold, nickel, steel, chrome, alloys of the foregoing materials, hastelloy, illium alloy, incoloy, and monel. Electrodes manufactured from the foregoing materials as well as from other materials having a high galvanic potential may be deployed without being covered by the coverings by the first covering 124A, the second covering 124B or another material having dielectric permittivity greater than the first threshold (such configuration hereafter referred to as being "uncoated"). In some embodiments, uncoated electrodes may be deployed more proximate to each other relative to electrodes that are covered by coverings 124A and 124B. Further, the gap between the electrodes may be reduced in order to increase the capacitive coupling between the electrodes to facilitate power transfer. The gap may also be reduced by attaching the electrodes to a flexible mount (not shown). In one of such embodiments, a spring loaded electrical connector (not shown) is deployed proximate the uncoated electrodes to facilitate a reduced gap between the electrodes. In another one of such embodiments, the flexible mount is a flexure, a swellable rubber, a bow spring, a coil spring, a wave spring, an elastomer, or is driven by an actuator. In one of such embodiments, a direct electrical contact is formed between electrodes deployed along the first and second strings 115 and 116. The direct electrical contact enables a resistive coupling between the electrodes as well as the capacitive coupling between the electrodes. The resistive coupling facilitates power transfer for AC signals and also facilitates power transfer for DC signals. Portions of the electrodes 122A-122F may be attached to the flexible mount and part of the electrode may be attached to a rigid mount. Further, one of the electrodes of the capacitive coupling may be attached to a flexible mount while the second electrode of the capacitive coupling may be attached to a rigid mount.

A first standoff 126A is deployed along the first string 115 and is deployed in between the first string 115 and the first and fourth electrodes 122A and 122D. Further, a second standoff 126B is deployed along the second string 116 and is deployed in between the second string 116 and the second, third, fifth, and sixth electrodes 122B, 122C, 122E, and 122F. In the preferred embodiment, the first and second standoffs 126A and 126B are manufactured front a material having a lower dielectric relative to the dielectric of the first and second coverings 124A and 124B. In some embodiments, the second material has a dielectric permittivity less than a second threshold, where the value of the second threshold is less than the value of the first threshold. The standoffs are preferably constructed from an insulator such as a polymer, a ceramic, or a glass. In one of such embodiments, the first and second standoffs 126A and 126B are manufactured from Polytetrafluoroethylene (PTFE). In another one of such embodiments, the first and second standoffs 126A and 126B are manufactured from rubber, swell rubber, paint, enamel, or a similar material.

A controller 128 is deployed along the second string 116 and is coupled to an electrical conduit 129. In some embodiments, the controller 128 is operable to detect response signals from the first and fourth electrodes 122A and 122D and is further operable to determine the signal intensities of the response signals to determine whether the second and third electrodes 122B and 122C are aligned with the first and fourth electrodes 122A and 122D, respectively. More particularly, the controller 128 determines that the second and third electrodes 122B and 122C are not aligned with the first and fourth electrodes 122A and 122D, respectively, if the signal intensities of the response signals are not greater than a first threshold. If the controller determines that the signal intensities of the response signals are greater than the first threshold, then controller 128 determines that the second and third electrodes 122B and 122C are aligned with the first and fourth electrodes 122A and 122D, respectively. Alternatively, if the controller 128 determines that the foregoing electrodes 122A-122D are not aligned the controller 128 is further operable to transmit an indication that the electrodes are not aligned. In some embodiments, the indications are transmitted via the umbilical or via another telemetry system to the control 184. An operator may operate the control 184 to re-position the second string 116 to align the foregoing electrodes 122A-122D.

The second electrode 122B and the first electrode 122A form a first capacitive coupling, and the third electrode 122C and the fourth electrode 122D form a third capacitive coupling, once the electrodes are aligned. The controller 128 then transfers electrical currents across at least one of the second and third electrodes 122B and 122C to provide power and/or data transmission to an electrical load 130 that is deployed along the first string 115, In some embodiments, the controller 128 is operable to modulate one or more of the frequency, amplitude, and phase of the electrical currents to regulate power transmitted to the electrical load 130 and also to transmit data to the electrical load 130. For example, the controller 128 is operable to vary transmission frequency based on whether the transmission is a power transmission or a data transmission. More particularly, the controller 128 is operable to vary the transmission frequency of power transmissions from 100 Hz to 100 MHz and is operable to vary the transmission frequency of data transmissions from 100 Hz to 100 MHz. The controller 128 is further operable to vary the power transmission within specific ranges of the foregoing power transmission and frequency transmission ranges. For example, the controller 128 is operable to vary the transmission frequency of the power transmissions to 1 MHz to 10 MHz and is further operable to vary the transmission frequency of the data transmission to 1 kHz to 10 kHz.

In another one of such embodiments, the controller 128 is further operable to modulate electrical currents transferred from the electrical conduit 129 to improve the first capacitive coupling, the third capacitive coupling, as well as other capacitive couplings formed front electrodes deployed on the first and second strings 115 and 116. For example, the controller 128 is operable to convert a direct current transferred from the electrical conduit 129 to an alternating current for electrical coupling. Further, the controller 128 is operable to monitor the electrical coupling to optimize the coupling efficiency, the power transfer, the current transfer, the voltage transfer, the signal to noise ratio (SNR), the signal to interference-plus noise ratio (SINR) heat generation, a combination of the foregoing properties, or similar properties. Moreover, the controller 128 is operable to monitor the real part of the electrical impedance (real impedance), the imaginary part of the electrical impedance (imaginary impedance), the current, the voltage, the phase of the current and/or the voltage, the amplitude, or another property of the electrical currents/signals.

In some embodiments, the electrical load 130 includes or is coupled to one or more electronics or components thereof that are operable to modulate electrical currents transferred from the second string 116. In one of such embodiments, the electrical load 130 includes or is coupled to a rectifier that is operable to convert alternating current to direct current. In another one of such embodiments, the electrical load 130 includes or is coupled to a band pass filter (e.g., high band pass filter, low band pass filter, etc.), band stop filter, or another component operable to filter the electrical currents based on frequency, amplitude, and/or phase, In a further one of such embodiments, the electrical load 130 is also coupled to or includes one or more buck components, boost components, transformers, or a similar component that is operable to modulate the voltage (e.g., step up, step down, etc.) of the electrical load 130.

Figure 3:
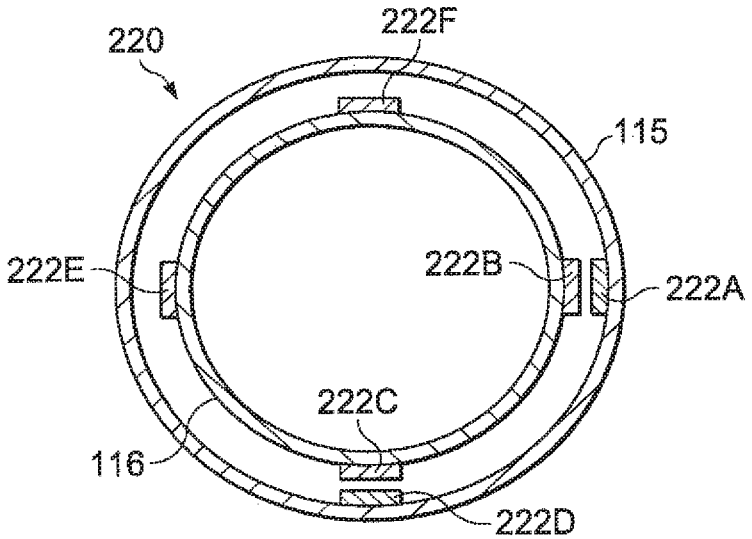
FIG. 3 is an enlarged, cross-sectional view of a downhole capacitive coupling system having multiple electrodes deployed radially along surfaces of the first string and the second string, both of which are deployed in a hydrocarbon production environment similar to that of FIG. 1.

FIG. 3 is an enlarged, cross-sectional view of a downhole capacitive coupling system 220 having multiple electrodes 222A-222F deployed radially along surfaces of the first string 115 and the second string 116, both of which are deployed in a hydrocarbon production environment similar to that of FIG. 1. As discussed herein and illustrated in the equations set forth below, power loss from the electrodes is directly proportional to the size of the surface area of the electrodes 222A-222F and the energy transfer is directly proportional to the size of the capacitive coupling. As can be seen from FIG. 3, electrodes 222E and 222F are not part of the capacitive coupling because there is no matching electrodes on the first string 115. In order to reduce power loss from the electrodes 222E and 222F, the controller could choose to only provide power to electrodes 222C and 222B. In some embodiments, insulators (not shown) may be deployed radially and at circumferential locations adjacent to the electrodes 222A-222F to reduce electrical shorting between the electrodes and the string in cases where the wellbore fluid is electrically conductive and to facility other functions discussed herein.

Figure 4A:
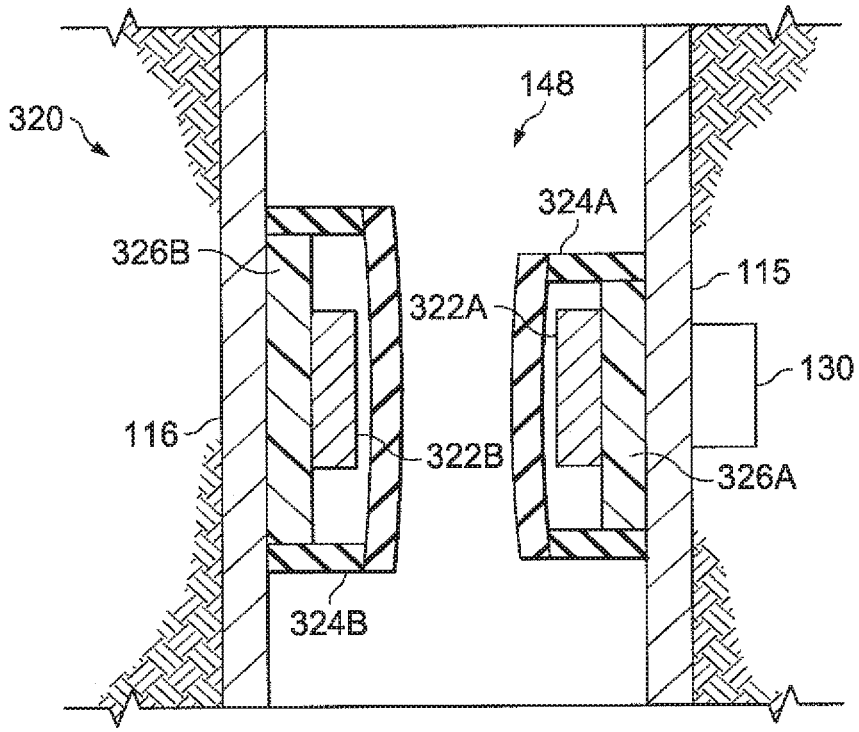
FIG. 4A is an enlarged, side view of a downhole capacitive coupling system having a first electrode deployed along the first string and a second electrode deployed along the second string, the first and second electrodes being aligned to form a capacitive coupling.

FIG. 4A is an enlarged, side view of a downhole capacitive coupling system 320 having a first electrode 322A deployed along the first string 115 and a second electrode 322B deployed along the second string 116, the first and second electrodes 322A and 322B being aligned to form a capacitive coupling. A first and second coverings 324A and 324B are deployed proximate the first and second electrodes 322A and 322B, respectively to protect the first and second electrodes 322A and 322B against corrosion. Further, a first standoff 326A is deployed in between the first electrode 322A and the first string 115, and a second standoff 326B is deployed in between the second electrode 322B and the second string 116.

Figure 4B:
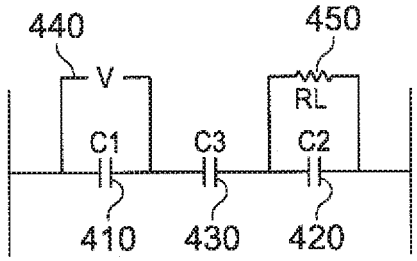
FIG. 4B is a circuit diagram of the downhole capacitive coupling system of FIG. 4A.

FIG. 4B is a circuit diagram of the downhole capacitive coupling system of FIG. 4A. The following equations may be derived and used to calculate the capacitance of the capacitive coupling, power into the electrical load 130, as well as total power. $C_3$ 430 represents the first capacitive coupling formed between the first electrode 322A and the second electrode 322B, when the electrodes are aligned with each other. The capacitive coupling 430 may be calculated based on the following equation:

$$C_3 = \varepsilon_0' * \varepsilon_3 * \frac{A_2}{t_3},$$

where $\varepsilon_0$ is the permittivity of free space, $\varepsilon_3$ is the dielectric constant across the first and second electrodes 322A and 322B, $A_2$ is the surface area of the second electrode, and $t_3$ is dielectric thickness (distances between the first and second electrodes 322A and 322B). The capacitive coupling 430 is offset by losses due to capacitive coupling $C_1$ 410 between the first electrode 322A and the first string 115, and due to capacitive coupling $C_2$ 420 between second electrode 322B and the second string 116, $C_1$ 410 may be calculated based on the following equation:

$$C_1 = \varepsilon_0 * \varepsilon_1 * \frac{A_1}{t_1},$$

where $\varepsilon_0$ is the permittivity of free space, $\varepsilon_1$ is the dielectric constant of the first electrode 322A, $A_1$ is the surface area of the first electrode, and $t_1$ is dielectric thickness of the first electrode 322A. Further $C_2$ 420 may be calculated based on the following equation:

$$C_2 = \varepsilon_0 * \varepsilon_2 * \frac{A_2}{t_2},$$

where $\varepsilon_0$ is the permittivity of free space, $\varepsilon_2$is the dielectric constant of the second electrode 322B, $A_2$ is the surface area of the second electrode, and $t_2$ is dielectric thickness of the second electrode 322B.

Power to the electrical load 130 is calculated based on the following equation:

$$P_L = \frac{1}{R_L} * V_1^2 * \left(1 - \frac{R_3 * (R_2 + R_L)}{R_3 * (R_2 + R_L) + R_2 * R_L}\right)^2,$$

where $V_1$ is the voltage of the drive signal, $R_L$ 450 is the resistance across the electrical load 130, $R_3$ is the resistivity across the first and second electrodes 322A and 3228, and $R_1$ and $R_2$ are internal resistivities of $C_1$ and $C_2$, respectively. Further, total power in may be calculated based on the following equation:

$$P_T = V_1^2 * \left(\frac{1}{R_1} + \frac{(R_2 + R_L)}{R_3 + (R_2 + R_L) + R_2 * R_L}\right),$$

where $V_1$ is the voltage of the drive signal, $R_L$, 450 is the resistance across the electrical load 130, $R_3$ is the resistivity across the first and second electrodes 322A and 3228, and $R_1$ and $R_2$ are internal resistivities of $C_1$ and $C_2$, respectively.

The circuit diagram of FIG. 4B shows half of the electrical circuit. The electrical circuit can be completed with either a second capacitive coupling (not shown), which may be formed by a second pair of electrodes. In another embodiment, the electrical circuit can be completed with a resistive coupling, which may be formed if the first and second strings 115 and 116 are in direct contact with each other. In a further embodiment, the electrical circuit is completed with a combination of capacitive coupling and resistive coupling. Further in sonic embodiments, one or more inductors (not shown) may be added in parallel or in series to the drive side of the circuit illustrated in FIG. 4B, in parallel or in series to the electrical load side of the circuit, to both the drive side and load side, or to a ground to form a resonant system for power transmission. In one of such embodiments, the resonant system further augments power transmission efficiency across the capacitive coupling 430.

Figure 5:
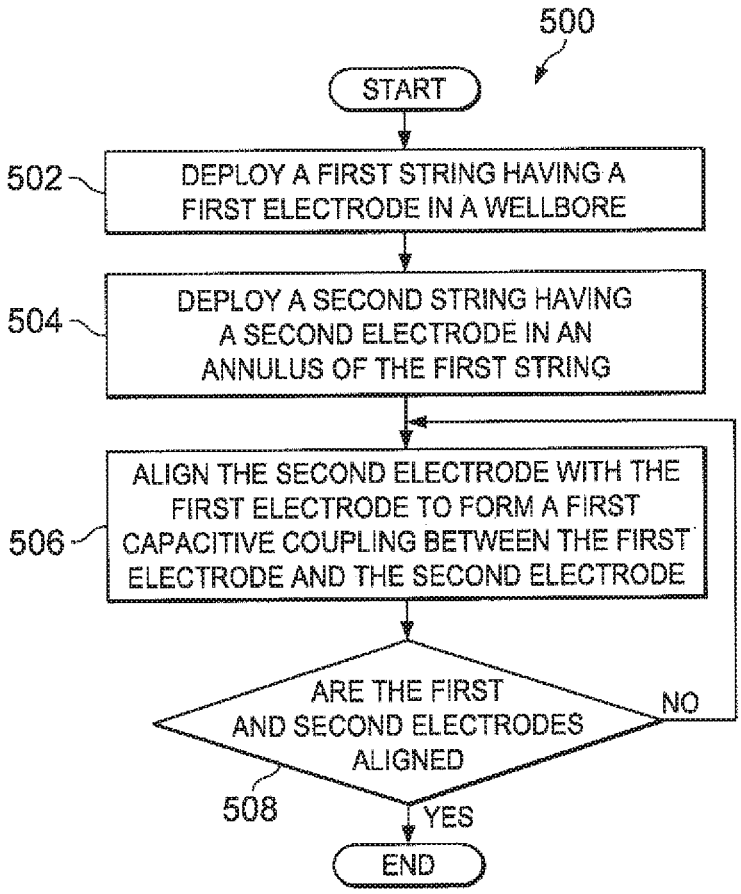
FIG. 5 is a flow chart of a process to form an electrical connection between the first and the second strings.

FIG. 5 is a flow chart of a process to form an electrical connection between the first and the second strings. Although operations in the process 500 are shown in a particular sequence, certain operations may be perforated in different sequences or at the same time where feasible.

At step 502, a first string 115 having a first electrode is deployed in the wellbore 106. At step 504, a second string 116 having a second electrode is deployed in the wellbore 106. In some embodiments, where the first string 115 is a production casing, and the second string 116 is a production tubing, the first string 115 may be deployed well in advance of the second string 116. Further, in some embodiments, the first string 115 is permanently deployed in the wellbore 106 during the operation of the well 102, whereas the second string 116 may be removed from the wellbore 106 during the operation of the well 102. At step 506, the second electrode 122B is aligned with the first electrode 122A to form a first capacitive coupling when the second electrode 122B is aligned with the first electrode 122A. In some embodiments, the controller 128 is operable to detect signals indicative of whether the second electrode 122B is aligned with the first electrode 122A. At step 508, the controller 128 or another controller that is deployed downhole or on the surface (such as the rig crew) determines whether the first and second electrodes 122A and 122B are properly aligned.

In some embodiments, the controller 128 is operable to receive signals indicative of a response from the first electrode 122A and is operable to determine whether the first and second electrodes 122A and 122B are properly aligned based on whether the signal intensity of the signals is greater than a first signal threshold. If the signal intensity of the signals is greater than the first threshold, then the controller 128 determines that the first and second electrodes 122A and 122B are properly aligned. Alternatively, if the signal intensity of the signals is not greater than the first signal threshold, then the process returns to step 506, and the controller 128 transmits an indication that the first and second electrodes 122A and 122B are not aligned to the control 184, or another surface based or downhole control. An operator may operate the control 184 to reposition the second string 116 to align the first electrode 122A with the second electrode 122B to form the first capacitive coupling. Once the first and the second electrodes 122A and 122B are aligned, the controller 128 drives electrical currents across the first capacitive coupling to transmit power and/or data to an electrical load that is deployed proximate the first string 115. In some embodiments, the controller 128 is operable to modulate at least one of the amplitude, frequency, and phase to regulate power and data transmission.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a downhole capacitive coupling system, comprising a first electrode deployed along an internal surface of a first string deployed in a wellbore, the internal surface being defined by an annulus; and a second electrode deployed along an external surface of a second string, the second string being deployed within the annulus, and the external surface of the second string and the internal surface of the first string being separated from each other by the annulus, wherein the first electrode and the second electrode are operable to form a first capacitive coupling between said first electrode and said second electrode to transfer electrical current from the second electrode to the first electrode.

Clause 2, the downhole capacitive coupling system of clause 1, further comprising an electrical load deployed on the first string, wherein the electrical current is transferred across the first capacitive coupling to provide power to the electrical load.

Clause 3, the downhole capacitive coupling system of clause 1 or 2, wherein the electrical current comprises electrical signals indicative of data, and wherein the electrical current is transferred across the first capacitive coupling to transmit data to the electrical load.

Clause 4, the downhole capacitive coupling system of at least one of clauses 1-3, further comprising a controller operable to modulate at least one of a phase and amplitude of the electrical current to transmit different electrical signals indicative of data to the electrical load.

Clause 5, the downhole capacitive coupling system of at least one of clauses 1-4, further comprising a first covering deployed around the first electrode; and a second covering deployed around the second electrode, wherein the first covering and the second covering are manufactured from a first material having a dielectric permittivity greater than a first threshold.

Clause 6, the downhole capacitive coupling system of at least one of clauses 1-5, further comprising: a first standoff deployed in between the first string and the first electrode; and a second standoff deployed in between the second string and the second electrode, wherein the first standoff and the second standoff are manufactured from a second material having a dielectric permittivity less than a second threshold, the second threshold having a value that is less than the first threshold.

Clause 7, the downhole capacitive coupling system of at least one of clauses 1-6, wherein the first material is manufactured from at least one of silicon carbide, silicon nitride, and rubber, and wherein the second material is manufactured from Polytetrafluoroethylene (PTFE).

Clause 8, the downhole capacitive coupling system of at least one of clauses 1-7, further comprising a third electrode deployed along the second string, and operable determine whether the second electrode is aligned with the third electrode; and transfer the electrical current across the second capacitive coupling upon determining that the second electrode is aligned with the third electrode, Clause 9, the downhole capacitive coupling system of at least one of clauses 1-8, further comprising: a fourth electrode deployed along the first string, the third electrode and the fourth electrode operable to determine if the second electrode is aligned with the first electrode and if the third electrode is aligned with the fourth electrode; and transfer the electrical current across the first capacitive coupling to provide power across the first capacitive coupling, and across the third capacitive coupling to transmit electrical signal indicative of data across the third capacitive coupling if the second electrode is aligned with the first electrode and if the third electrode is aligned with the fourth electrode.

Clause 10, the downhole capacitive coupling system of at least one of clauses 1-9, wherein the first suing is a permanent completion having a first screen disposed on a section of the first string, and further comprising a first set of sensors deployed along the first string and proximate to the first screen, wherein the first set of sensors comprises one or more sensors operable t: generate power from the electrical current; and Monitor material properties of fluids and materials flowing through the first screen; and a first set of tools deployed along the first string and proximate to the first screen, wherein the first set of tools comprises one or more tools operable to generate power from the electrical current; and control a flow rate of fluids and materials flowing through the first screen.

Clause 11, the downhole capacitive coupling system of at least one of clauses 1-10, wherein the first and second strings form a resistive coupling, and wherein the electrical current is transferred across the resistive coupling to power the first set of sensors and the first set of tools.

Clause 12, a method to form an electrical connection between two downhole strings, the method comprising deploying a first string having a first electrode in a wellbore, the first string having an internal surface defined by an annulus; deploying a second string having a second electrode in the annulus of the first string; and aligning the second electrode with the first electrode to form a first capacitive coupling between said first electrode and said second electrode.

Clause 13, the method of clause 12, wherein aligning the second electrode with the first electrode further comprises receiving signals indicative of a response from the first electrode; and determining if a signal intensity the signals is greater than a first signal threshold, wherein the second electrode is aligned with the first electrode if the signal intensity of the signals is greater than the first signal threshold.

Clause 14, the method of clause 12 or 13, further comprising transferring an electrical current from the second electrode, across the first capacitive coupling, to the first electrode to provide power to an electrical load deployed on the first string.

Clause 15, the method of at least one of clauses 12-14, further comprising transferring an electrical current from the second electrode to the first electrode to transmit electrical signals indicative of data, to an electrical load deployed on the first string.

Clause 16, the method of at least one of clauses 12-15, further comprising modulating at least one of a phase and amplitude of the electrical current to transmit different electrical signals indicative of data to the electrical load.

Clause 17, the method of at least one of clauses 12-16, wherein a third electrode and a fourth electrode are deployed on the second string, and the first string, respectively, and further comprising: aligning the third electrode with the fourth electrode to form a third capacitive coupling between said third electrode and said fourth electrode; and transferring the electrical current from the third electrode, across the third capacitive coupling, to the fourth electrode to provide power to the electrical load.

Clause 18, an apparatus to provide an electrical connection between two downhole strings, comprising a first electrode deployed along a surface of a first string deployed in a wellbore, the first string having an internal surface defined by an annulus; a second electrode deployed along a surface of a second string, the second string being deployed within the annulus, and the surface of the second string and the surface of the first string being separated from each other by the annulus, the first electrode and the second electrode forming a first capacitive coupling between said first electrode and said second electrode to transfer electrical current from the second electrode to the first electrode; and a controller operable to modulate at least one of a frequency, phase and amplitude of the electrical current to provide at least one of power and data transmission to an electrical load deployed on the first string of the wellbore.

Clause 18, the apparatus of clause 18, further comprising a first covering deployed around the first electrode; and a second covering deployed around the second electrode, wherein the first covering and the second covering are manufactured from a first material having a dielectric permittivity greater than a first threshold.

Clause 20, the apparatus of claim 19, further comprising a first standoff deployed in between the first string and the first electrode; and a second standoff deployed in between the second string and the second electrode, wherein the first standoff and the second standoff are manufactured from a second material having a dielectric permittivity less than a second threshold, the second threshold having a value that is less than the first threshold.

Although certain embodiments disclosed herein describes transferring electrical currents from electrodes deployed on an inner string to electrodes deployed on an outer string, one of ordinary skill would understand that the subject technology disclosed herein may also be implemented to transfer electrical currents from electrodes deployed on the outer string to electrodes deployed on the inner string.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A downhole capacitive coupling system, comprising:

a first electrode deployed along an internal surface of a first string deployed in a wellbore, the internal surface being defined by an annulus, and the first string being a permanent completion having a first screen disposed on a section of the first string; and a second electrode deployed along an external surface of a second string, the second string being deployed within the annulus, and the external surface of the second string and the internal surface of the first string being separated from each other by the annulus, wherein the first electrode and the second electrode are operable to form a first capacitive coupling between said first electrode and said second electrode to transfer electrical current from the second electrode to the first electrode;

a controller operable to:

determine whether the first electrode is aligned with the second electrode; and transfer the electrical current across the first capacitive coupling upon determining that the first electrode is aligned with the second electrode;

a first set of sensors deployed along the first string and proximate to the first screen, wherein the first set of sensors comprises one or more sensors operable to monitor material properties of fluids and materials flowing through the first screen; and a first set of tools deployed along the first string and proximate to the first screen, wherein the first set of tools comprises one or more tools operable to control a flow rate of fluids and materials flowing through the first screen.

2. The downhole capacitive coupling system of claim 1, further comprising an electrical load deployed on the first string, wherein the electrical current is transferred across the first capacitive coupling to provide power to the electrical load.

3. The downhole capacitive coupling system of claim 2, wherein the electrical current comprises electrical signals indicative of data, and wherein the electrical current is transferred across the first capacitive coupling to transmit data to the electrical load.

4. The downhole capacitive coupling system of claim 3, wherein the controller is further operable to modulate at least one of a phase, frequency, and amplitude of the electrical current to transmit different electrical signals indicative of data to the electrical load.

5. The downhole capacitive coupling system of claim 1, further comprising:

a first covering deployed around the first electrode; and a second covering deployed around the second electrode, wherein the first covering and the second covering are manufactured from a first material having a dielectric permittivity greater than a first threshold.

6. The downhole capacitive coupling system of claim 5, further comprising:

a first standoff deployed in between the first string and the first electrode; and a second standoff deployed in between the second string and the second electrode, wherein the first standoff and the second standoff are manufactured from a second material having a dielectric permittivity less than a second threshold, and the second threshold having a value that is less than the first threshold.

7. The downhole capacitive coupling system of claim 6, wherein the first material is manufactured from at least one of silicon carbide, silicon nitride, and rubber, and wherein the second material is manufactured from Polytetrafluoroethylene (PTFE).

8. The downhole capacitive coupling system of claim 1, further comprising:

a third electrode deployed along the second string, and operable to form a second capacitive coupling between the third electrode and the first electrode to transfer the electrical current from the third electrode to the first electrode; and wherein the controller is further operable to:

determine whether the second electrode is aligned with the third electrode; and transfer the electrical current across the second capacitive coupling upon determining that the second electrode is aligned with the third electrode.

9. The downhole capacitive coupling system of claim 8, further comprising:

a fourth electrode deployed along the first string, the third electrode and the fourth electrode operable to form a third capacitive coupling between said third electrode and said fourth electrode to transfer the electrical current from the third electrode to the fourth electrode, wherein the controller is further operable to:

determine if the second electrode is aligned with the first electrode and if the third electrode is aligned with the fourth electrode; and transfer the electrical current across the first capacitive coupling to provide power across the first capacitive coupling, and across the third capacitive coupling to transmit electrical signal indicative of data across the third capacitive coupling if the second electrode is aligned with the first electrode and if the third electrode is aligned with the fourth electrode.

10. The system of claim 1, wherein the first and second strings form a resistive coupling, and wherein the electrical current is transferred across the resistive coupling to power the first set of sensors and the first set of tools.

11. A method to form an electrical connection between two downhole strings, the method comprising:

deploying a first string having a first electrode in a wellbore, the first string having an internal surface defined by an annulus, and the first string being a permanent completion having a first screen disposed on a section of the first string;

deploying a second string having a second electrode in the annulus of the first string;

aligning the second electrode with the first electrode to form a first capacitive coupling between said first electrode and said second electrode;

determining whether the first electrode is aligned with the second electrode;

transfering the electrical current across the first capacitive coupling upon determining that the first electrode is aligned with the second electrode;

monitoring material properties of fluids and materials flowing through the first screen, wherein monitoring the material properties of fluids and materials is performed by a first set of sensors deployed along the first string and proximate to the first screen; and controlling a flow rate of fluids and materials flowing through the first screen, wherein controlling the flow rate of fluids and materials is performed by a first set of tools deployed along the first string and proximate to the first screen.

12. The method of claim 11, wherein aligning the second electrode with the first electrode further comprises:

receiving signals indicative of a response from the first electrode;

determining if a signal intensity of the signals is greater than a first signal threshold; and determining that the second electrode is aligned with the first electrode in response to a determination that the signal intensity of the signals is greater than the first signal threshold.

13. The method of claim 11, further comprising transferring an electrical current from the second electrode, across the first capacitive coupling, to the first electrode to provide power to an electrical load deployed on the first string.

14. The method of claim 11, further comprising transferring an electrical current from the second electrode to the first electrode to transmit electrical signals indicative of data to an electrical load deployed on the first string.

15. The method of claim 14, further comprising modulating at least one of a phase and amplitude of the electrical current to transmit different electrical signals indicative of data to the electrical load.

16. The method of claim 14, wherein a third electrode and a fourth electrode are deployed on the second string, and the first string, respectively, and further comprising:

aligning the third electrode with the fourth electrode to form a second capacitive coupling between said third electrode and said fourth electrode; and transferring the electrical current from the third electrode, across the second capacitive coupling, to the fourth electrode to provide power to the electrical load.

17. An apparatus to provide an electrical connection between two downhole strings, comprising:

a first electrode deployed along a surface of a first string deployed in a wellbore, the first string having an internal surface defined by an annulus, and the first string being a permanent completion having a first screen disposed on a section of the first string;

a second electrode deployed along a surface of a second string, the second string being deployed within the annulus, and the surface of the second string and the surface of the first string being separated from each other by the annulus, the first electrode and the second electrode forming a first capacitive coupling between said first electrode and said second electrode to transfer electrical current from the second electrode to the first electrode;

a third electrode deployed along the second string, and operable to form a second capacitive coupling between the third electrode and the first electrode to transfer the electrical current from the third electrode to the first electrode; and a controller operable to;

modulate at least one of a frequency, phase and amplitude of the electrical current to provide at least one of power and data transmission to an electrical load deployed on the first string of the wellbore;

determine whether the first electrode is aligned with the second electrode;

transfer the electrical current across the first capacitive coupling upon determining that the first electrode is aligned with the second electrode; and transfer the electrical current across the second capacitive coupling upon determining that the second electrode is aligned with the third electrode.

18. The apparatus of claim 17, further comprising:

a first covering deployed around the first electrode; and a second covering deployed around the second electrode, wherein the first covering and the second covering are manufactured from a first material having a dielectric permittivity greater than a first threshold.

19. The apparatus of claim 18, further comprising:

a first standoff deployed in between the first string and the first electrode; and a second standoff deployed in between the second string and the second electrode, wherein the first standoff and the second standoff are manufactured from a second material having a dielectric permittivity less than a second threshold, the second threshold having a value that is less than the first threshold.

* * * * *